US011335530B2

(12) United States Patent
Park

(10) Patent No.: US 11,335,530 B2
(45) Date of Patent: May 17, 2022

(54) ELECTRON EMISSION STRUCTURE AND X-RAY TUBE INCLUDING THE SAME

(71) Applicant: ELECTRONICS AND TELECOMMUNICATIONS RESEARCH INSTITUTE, Daejeon (KR)

(72) Inventor: Sora Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 38 days.

(21) Appl. No.: 17/093,896

(22) Filed: Nov. 10, 2020

(65) Prior Publication Data

US 2021/0151272 A1 May 20, 2021

(30) Foreign Application Priority Data

Nov. 18, 2019 (KR) ..... 10-2019-0147873
Oct. 26, 2020 (KR) ..... 10-2020-0139137

(51) Int. Cl.
*H01J 35/06* (2006.01)
*H01J 1/304* (2006.01)

(52) U.S. Cl.
CPC ..... *H01J 35/065* (2013.01); *H01J 1/304* (2013.01); *H01J 2235/062* (2013.01); *H01J 2235/068* (2013.01)

(58) Field of Classification Search
CPC .... H01J 35/065; H01J 1/304; H01J 2235/062; H01J 2235/068; H01J 2201/30403; H01J 2201/3043
See application file for complete search history.

(56) References Cited

U.S. PATENT DOCUMENTS 8,016,633 B2 9/2011 Jiang et al.
2003/0142790 A1* 7/2003 Zhou ..... H01J 35/153 378/119
2007/0200478 A1* 8/2007 Dijon ..... H01J 1/304 313/311
2012/0194058 A1* 8/2012 Wei ..... H01J 1/304 313/496
2012/0220182 A1* 8/2012 Wei ..... H01J 1/316 977/939

(Continued)

*Primary Examiner* — Chih-Cheng Kao
(74) *Attorney, Agent, or Firm* — Rabin & Berdo, P.C.

(57) ABSTRACT

An electron emission structure according to embodiments of the inventive concept includes a cathode electrode and electron emission yarns each having a yarn shape and disposed in the cathode electrode. Here, the cathode electrode includes a plurality of first conductive panels spaced apart from each other in a first direction and at least one second conductive panel that crosses the first conductive panels in the first direction. Also, each of the first conductive panels includes at least one groove at an upper portion thereof. The second conductive panel is inserted to the groove of each of the first conductive panels. Each of the electron emission yarns is disposed between the first conductive panels. Each of the electron emission yarns contacts the second conductive panel. Each of the electron emission yarns is mechanically fixed and vertically aligned as well as arranged regularly by the second conductive panel and one pair of adjacent first conductive panels of the first conductive panels.

18 Claims, 14 Drawing Sheets

(56) References Cited

U.S. PATENT DOCUMENTS

| | | | | |
|---|---|---|---|---|
| 2014/0159566 | A1* | 6/2014 | Liu ..... | H01J 1/304<br>313/346 R |
| 2015/0146865 | A1 | 5/2015 | Kim et al. | |
| 2015/0216025 | A1 | 7/2015 | Jeong et al. | |

* cited by examiner

ELECTRON EMISSION STRUCTURE AND X-RAY TUBE INCLUDING THE SAME

CROSS-REFERENCE TO RELATED APPLICATIONS

This U.S. non-provisional patent application claims priority under 35 U.S.C. § 119 of Korean Patent Application Nos. 10-2019-0147873, filed on Nov. 18, 2019, and 10-2020-0139137, filed on Oct. 26, 2020, the entire contents of which are hereby incorporated by reference.

BACKGROUND

The present disclosure herein relates to an electron emission structure and an X-ray tube including the same.

A nanomaterial used as an emitter may emit an electron to the outside of the nanomaterial through a quantum tunneling effect caused by an external electric field. An edge of the emitter necessarily has a sharp shape to effectively generate the electron emission process. Thus, elongated nanomaterials are widely used as the emitter. For example, the elongated nanomaterials having a high aspect ratio such as a carbon nanotube (CNT) may be used as an emitter of an electron emission structure. The emitter may be an electron emission yarn having a yarn shape.

In recent years, an apparatus including the electron emission structure such as an X-ray tube is widely used. Thus, researches on the electron emission structure are actively performed.

SUMMARY

The present disclosure provides an electron emission structure having improved reliability and an X-ray tube including the same.

An embodiment of the inventive concept provides an electron emission structure including: a cathode electrode; and electron emission yarns each having a yarn shape and disposed in the cathode electrode. Here, the cathode electrode includes: a plurality of first conductive panels spaced apart from each other in a first direction; and at least one second conductive panel that crosses the first conductive panels in the first direction. Also, each of the first conductive panels includes at least one groove at an upper portion thereof, the second conductive panel is inserted to the groove of each of the first conductive panels, each of the electron emission yarns is disposed between the first conductive panels, each of the electron emission yarns contacts the second conductive panel, and each of the electron emission yarns is mechanically fixed and vertically aligned by the second conductive panel and one pair of adjacent first conductive panels of the first conductive panels.

In an embodiment, each of the electron emission yarns may contact one pair of adjacent first conductive panels of the first conductive panels.

In an embodiment, the electron emission yarns may be spaced apart from each other in a second direction that crosses the first direction with the second conductive panel therebetween.

In an embodiment, each of the first conductive panels and the second conductive panel may have a plate shape, each of the first conductive panels may have a first thickness in the first direction, each of the first conductive panels may extend in the second direction, the second conductive panel may have a second thickness in the second direction, and the second conductive panel may extend in the first direction.

In an embodiment, the electron emission yarns may be arranged regularly in the first direction and the second direction, a first pitch between one pair of electron emission yarns, which are adjacent to each other in the first direction, may be a sum of the first thickness and a diameter of each of the electron emission yarns, and a second pitch between one pair of electron emission yarns, which are adjacent to each other in the second direction, may be a sum of the second thickness and the diameter of each of the electron emission yarns.

In an embodiment, each of both edges of the second conductive panel may be bent into an "L"-shape, and each of the both edges of the second conductive panel may extend in the second direction.

In an embodiment, each of the both edges of the second conductive panel may be spaced apart from outermost conductive panels of the first conductive panels in the first direction, and a portion of the electron emission yarns may be disposed between each of the both edges of the second conductive panel and the outermost conductive panels of the first conductive panels.

In an embodiment, each of the first conductive panels may include a plurality of grooves at an upper portion thereof, the second conductive panel may be provided in plurality, each of the second conductive panels may be inserted to each of the grooves, the second conductive panels may be spaced apart from each other in a second direction that crosses the first direction, and each of the electron emission yarns may be disposed between the second conductive panels.

In an embodiment, a spaced distance between one pair of adjacent first conductive panels of the first conductive panels may be equal to a diameter of each of the electron emission yarns.

In an embodiment, a spaced distance between one pair of adjacent second conductive panels of the second conductive panels may be equal to a diameter of each of the electron emission yarns.

In an embodiment, an upper portion of each of the electron emission yarns may vertically protrude further than each of a top surface of each of the first conductive panels and a top surface of the second conductive panel.

In an embodiment, a power supply may be connected to at least one of the first conductive panels and the second conductive panel, and the first conductive panels and the second conductive panel may contact each other.

In an embodiment of the inventive concept, an X-ray tube includes: an electron emission structure; an anode electrode spaced vertically from the electron emission structure; and a gate electrode disposed between the anode electrode and the electron emission structure. Here, the electron emission structure includes: a cathode electrode having a grid shape; and electron emission yarns each having a yarn shape and disposed at a corner of the grid shape. Also, the cathode electrode includes: a plurality of first conductive panels spaced apart from each other in a first direction; and at least one second conductive panel that crosses the first conductive panels in the first direction. Also, each of the first conductive panels includes at least one groove at an upper portion thereof, the second conductive panel is inserted to the groove, and one pair of adjacent first conductive panels of the first conductive panels and a portion of the second conductive panel between the one pair of first conductive panels provide the corner of the grid shape.

In an embodiment, each of the electron emission yarns may contact the one pair of first conductive panels and the second conductive panels.

In an embodiment, each of the electron emission yarns may have a height greater than that of the second conductive panel and equal to or less than that of each of the first conductive panels.

In an embodiment, each of the electron emission yarns may be fixed by the first conductive panels and the second conductive panel.

In an embodiment, the groove may have a width in a second direction that crosses the first direction, the second conductive panel may have a thickness in the second direction, and the thickness of the second conductive panel may be equal to the width of the groove.

In an embodiment, the groove may have a depth in a vertical direction, the second conductive panel may have a height in the vertical direction, and the height of the second conductive panel may be equal to the depth of the groove.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
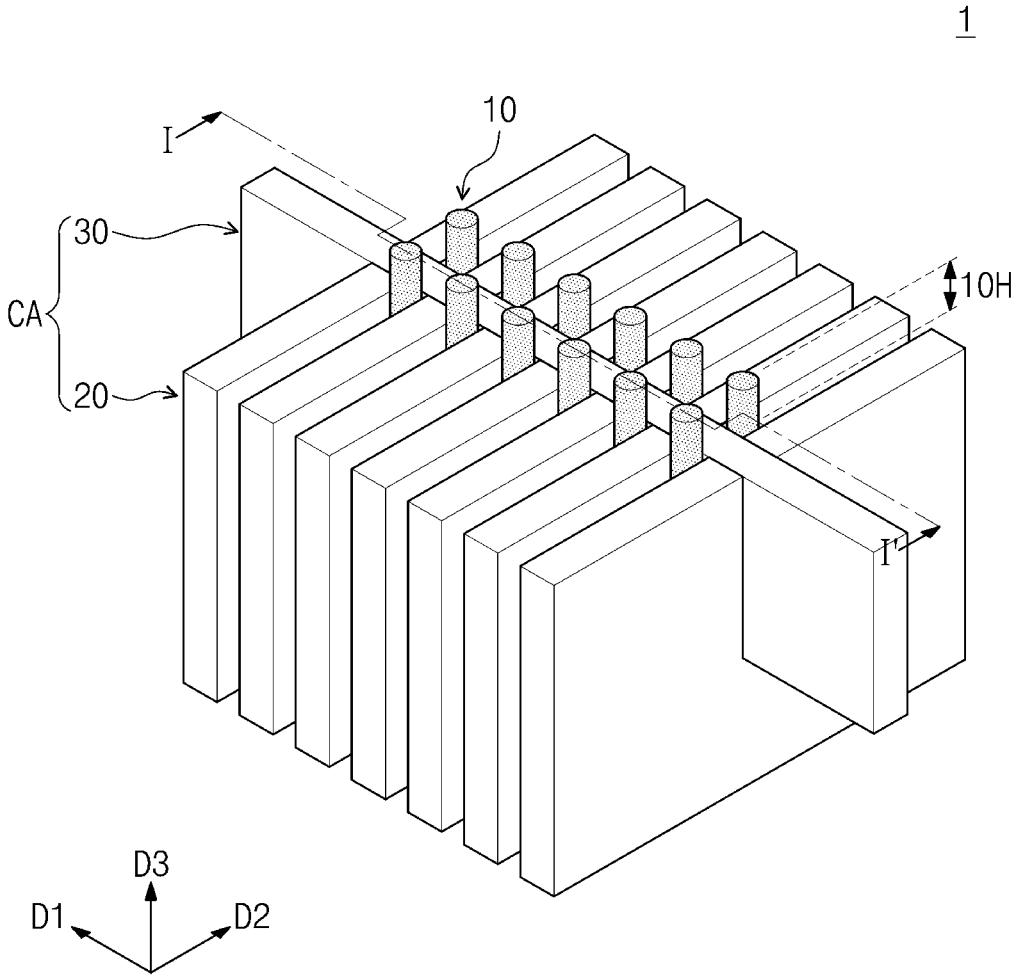
FIG. 1 is a perspective view for explaining an electron emission structure according to embodiments of the inventive concept.

Advantages and features of the present invention, and implementation methods thereof will be clarified through following embodiments described with reference to the accompanying drawings. The present invention may, however, be embodied in many different forms and should not be construed as being limited to the embodiments set forth herein. Rather, these embodiments are provided so that this disclosure will be thorough and complete, and will fully convey the concept of the invention to those skilled in the art. Further, the present invention is only defined by scopes of claims. Like reference numerals refer to like elements throughout.

In the following description, the technical terms are used only for explaining a specific exemplary embodiment while not limiting the present disclosure. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components. Hereinafter, embodiments of the inventive concept will be described in detail.

First Embodiment

Figure 2:
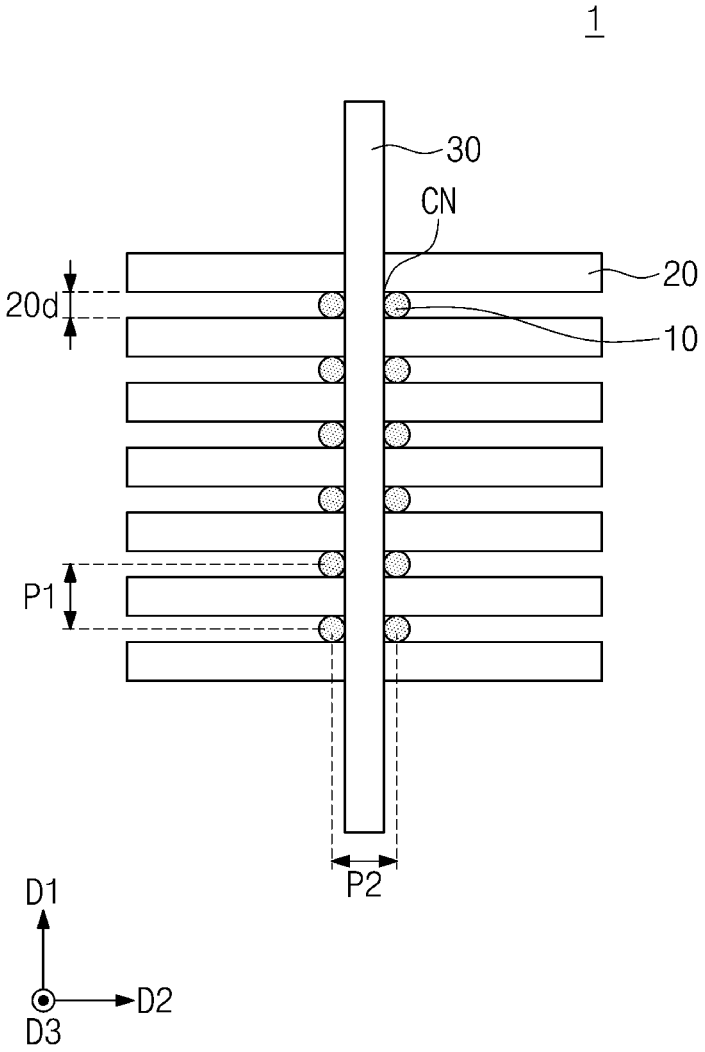
FIG. 2 is a plan view for explaining the electron emission structure according to the embodiments of the inventive concept.

FIG. 1 is a perspective view for explaining an electron emission structure according to embodiments of the inventive concept. FIG. 2 is a plan view for explaining the electron emission structure according to the embodiments of the inventive concept.

Referring to FIGS. 1 to 2, an electron emission structure 1 may be provided. In exemplary embodiments, the electron emission structure 1 may emit an electron by an electric field. The electron emission structure 1 may include a cathode electrode CA and an electron emission yarn 10.

The cathode electrode CA may include a plurality of first conductive panels 20 and a second conductive panel 30. Each of the first conductive panels 20 and the second conductive panel 30 may have a plate shape. Each of the first conductive panels 20 and the second conductive panel 30 may include a conductive material.

The electron emission yarn 10 may include a conductive material, a non-conductive material, or a semiconductor material. For example, the electron emission yarn 10 may include a carbon nanotube (CNT). In general, the electron emission yarn 10 may be provided by drawing and yarning yarn from a nanowire or a nanotube that is vertically grown on a substrate.

The first conductive panels 20 may be spaced apart from each other in a first direction D1. The first conductive panels 20 may be arranged with a predetermined gap in the first direction D1. The second conductive panel 30 may cross the first conductive panels 20 in the first direction D1. The electron emission yarns 10 may be disposed between the first conductive panels 20. The electron emission yarns 10 may be spaced apart from each other in a second direction D2 crossing the first direction D1 with the second conductive panel 30 therebetween. That is, the electron emission yarns 10 may have an array shape arranged with a predetermined gap in the first direction D1 and the second direction D2.

The first conductive panels 20 and the second conductive panel 30 may have, e.g., a grid shape. The grid shape may be similar to a comb shape. The first conductive panels 20 and the second conductive panel 30, which are adjacent to each other, may provide a corner CN of the grid. Each of the electron emission yarns 10 may be disposed at each corner CN.

Figure 3A:
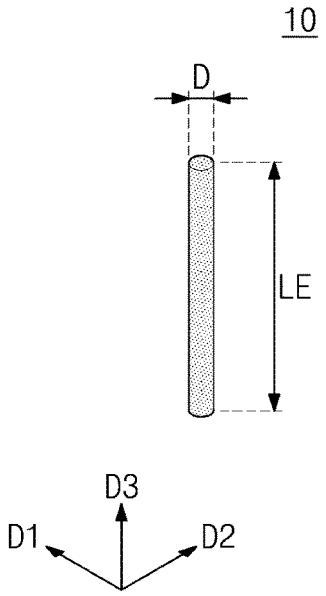
FIGS. 3A, 3B, and 3C are perspective views for explaining each of components of the electron emission structure according to the embodiments of the inventive concept.
Figure 3B:
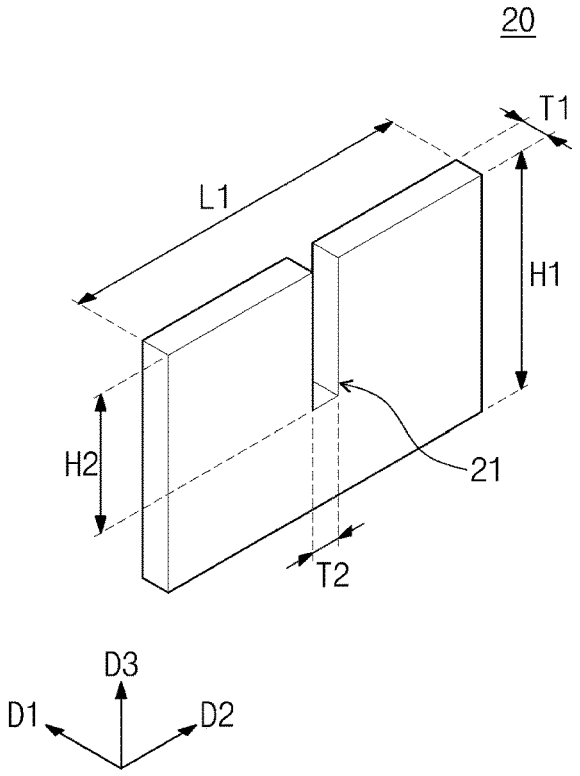
Figure 3C:
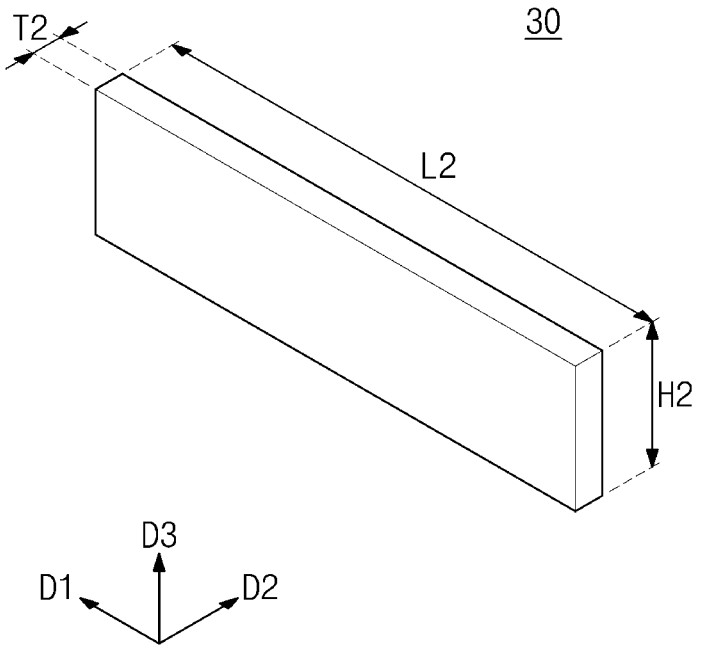

FIGS. 3A, 3B, and 3C are perspective views for explaining each of components of the electron emission structure according to the embodiments of the inventive concept. Specifically, FIGS. 3A, 3B, and 3C are perspective views of the electron emission yarn 10, the first conductive panel 20, and the second conductive panel 30, respectively.

Referring to FIG. 3A, the electron emission yarn 10 may have a yarn shape. The electron emission yarn 10 may have a cylindrical shape having a diameter D and a first length LE. The electron emission yarn 10 has a ratio of the diameter D to the first length LE, which is equal to or greater than about 1:10. The diameter D of the electron emission yarn 10 may be about 10 nm or more and about 1000 μm or less.

Referring to FIG. 3B, the first conductive panel 20 may have a first thickness T1 in the first direction D1, a second length L1 in the second direction D2, and a first height H1 in a third direction D3. The first thickness T1 may be greater than about 0 μm and equal to or less than about 10 mm.

Referring to FIG. 3C, the second conductive panel 30 may have a second thickness T2 in the second direction D2, a third length L2 in the first direction D1, and a second height H2 in the third direction D3. The second thickness T2 may be greater than about 0 μm and equal to or less than about 10 mm.

Referring to FIGS. 3B and 3C, the first conductive panel 20 may include a groove 21 at an upper portion thereof. A depth H2 and a width T2 of the groove 21 may be equal to the second height H2 and the second thickness T2 of the second conductive panel 30, respectively. That is, when the second conductive panel 30 is inserted to the groove 21 of the first conductive panel 20, a clearance is not substantially existed between the first conductive panel 20 and the second conductive panel 30

Referring to FIGS. 3A and 3C, the diameter D of the electron emission yarn 10 may be equal to or less than each of the first thickness T1 of the first conductive panel 20 and the second thickness T2 of the second conductive panel 30. The first length LE of the electron emission yarn 10 may be greater than the first height H1 of the first conductive panel 20. The first length LE of the electron emission yarn 10 may be equal to or less than the third length L2 of the second conductive panel 30.

Referring to FIG. 1 again, an upper portion of the electron emission yarn 10 may protrude further than each of a top surface of the first conductive panel 20 and a top surface of the second conductive panel 30. The protruding upper portion of the electron emission yarn 10 may have a length 10H greater than about 0 μm and equal to or less than about 1000 μm. According to an embodiment, a top surface of the electron emission yarn 10 may have substantially the same level as that of each of the top surface of the first conductive panel 20 and the top surface of the second conductive panel 30.

Referring to FIG. 2, a spaced distance 20*d* between the adjacent first conductive panels 20 may be substantially equal to the diameter D of the electron emission yarn 10. The electron emission yarns 10 may be regularly arranged based on a first pitch P1 and a second pitch P2. Specifically, the electron emission yarns 10 may have the first pitch P1 in the first direction D1. The first pitch P1 may be a sum of the diameter D of each of the electron emission yarns 10 and the first thickness T1 of the first conductive panel 20 in FIGS. 3A and 3B. The electron emission yarns 10 may have the second pitch P2 in the second direction D2. The second pitch P2 may be a sum of the diameter D of each of the electron emission yarns 10 and the second thickness T2 of the second conductive panel 30 in FIGS. 3A and 3C.

Figure 4:
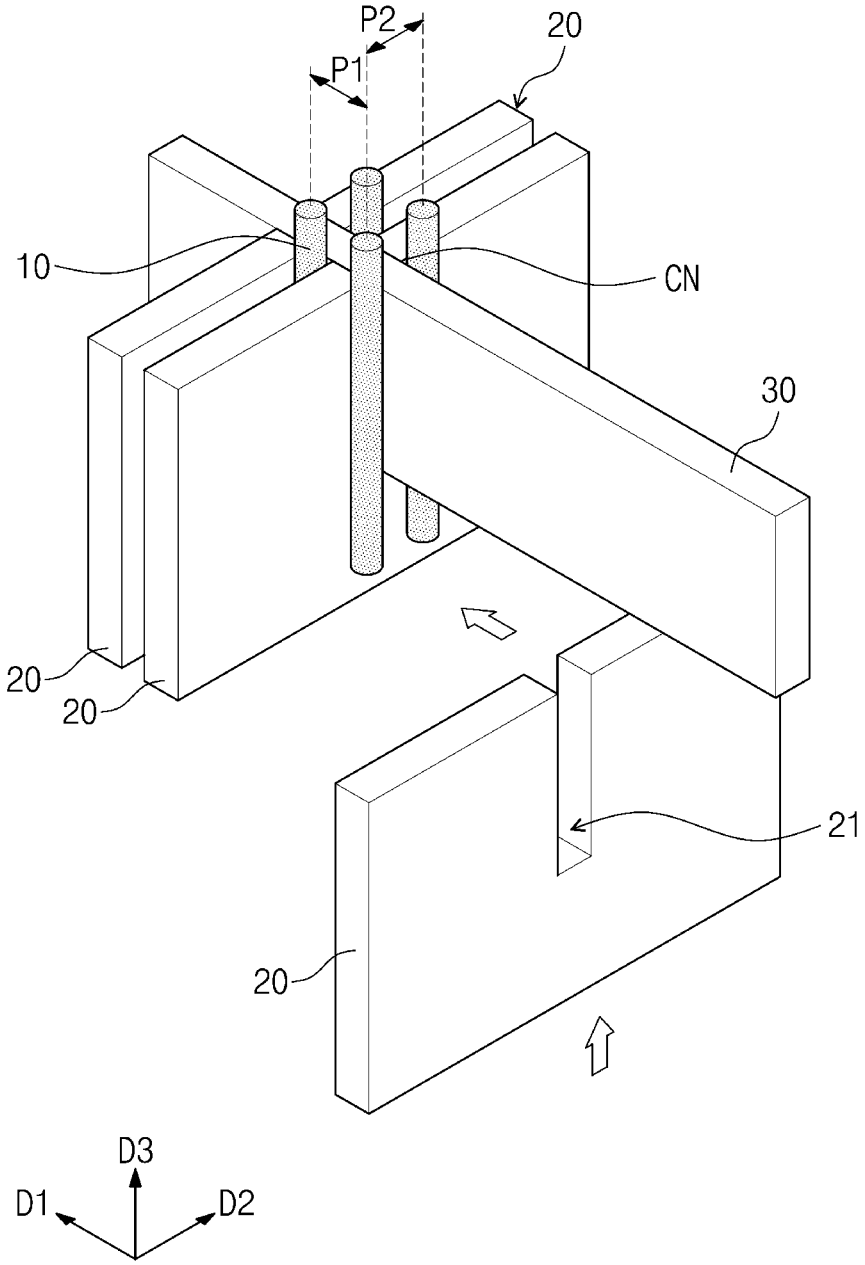
FIG. 4 is a conceptual view for explaining a process of manufacturing the electron emission structure according to the embodiments of the inventive concept.

FIG. 4 is a conceptual view for explaining a process of manufacturing the electron emission structure 1 in FIG. 1 according to the embodiments of the inventive concept. Referring to FIG. 4, the second conductive panel 30 may be inserted to the groove 21 of the first conductive panel 20. Thereafter, the electron emission yarn 10 may be positioned at the corner CN provided by the first conductive panel 20 and the second conductive panel 30. The electron emission yarn 10 may contact one the first conductive panel 20 and one second conductive panel 30.

Thereafter, the second conductive panel 30 may be inserted to the groove 21 of another first conductive panel 20. One pair of adjacent first conductive panels 20 may closely contact each other to fix the electron emission yarn 10. As a result, the electron emission yarn 10 may be fixed and vertically aligned between the first conductive panels 20 and the second conductive panel 30 even without an adhesive. Also, the electron emission yarns 10 may be arranged with the first pitch P1 in the first direction D1 and with the second pitch P2 in the second direction D2.

In case of the electron emission yarn having an elongated yarn shape, the electron emission yarn is hardly fixed in a standing state in a longitudinal direction thereof due to a structural property. According to a typical method, the electron emission yarn, which is cut into a predetermined length, is attached to a cathode electrode with an arbitrary form by additionally using a paste-type adhesive material. Since the above-described method includes a chemical additive, the method causes degradation in property of the electron emission yarn that is a vacuum device and hardly maintains the standing state of the electron emission yarn. In case of the embodiment of the inventive concept, the electron emission yarns 10 are mechanically fixed and vertically aligned in the longitudinal direction D3 by the first conductive panels 20 and the second conductive panel 30 without any additive materials, so that the degradation of the vacuum device may be relatively prevented.

Also, according to the typical method, when a plurality of electron emission yarns is configured in an array form, it is difficult to regularly arrange the electron emission yarns are. In case of the embodiment of the inventive concept, as the electron emission yarns 10 are spaced apart from each other by thicknesses of the first conductive panels 20 and the second conductive panel 30, the electron emission yarns 10 may be regularly arranged with a predetermined gap.

Also, the first pitch P1 and the second pitch P2 of the electron emission yarns 10 may be adjusted by the first thickness T1 of the first conductive panel 20 and the second thickness T2, and the electron emission yarns 10 may be arranged according to a rule that is controllable by the first pitch P1 and the second pitch P2.

[X-Ray Tube]

Figure 5:
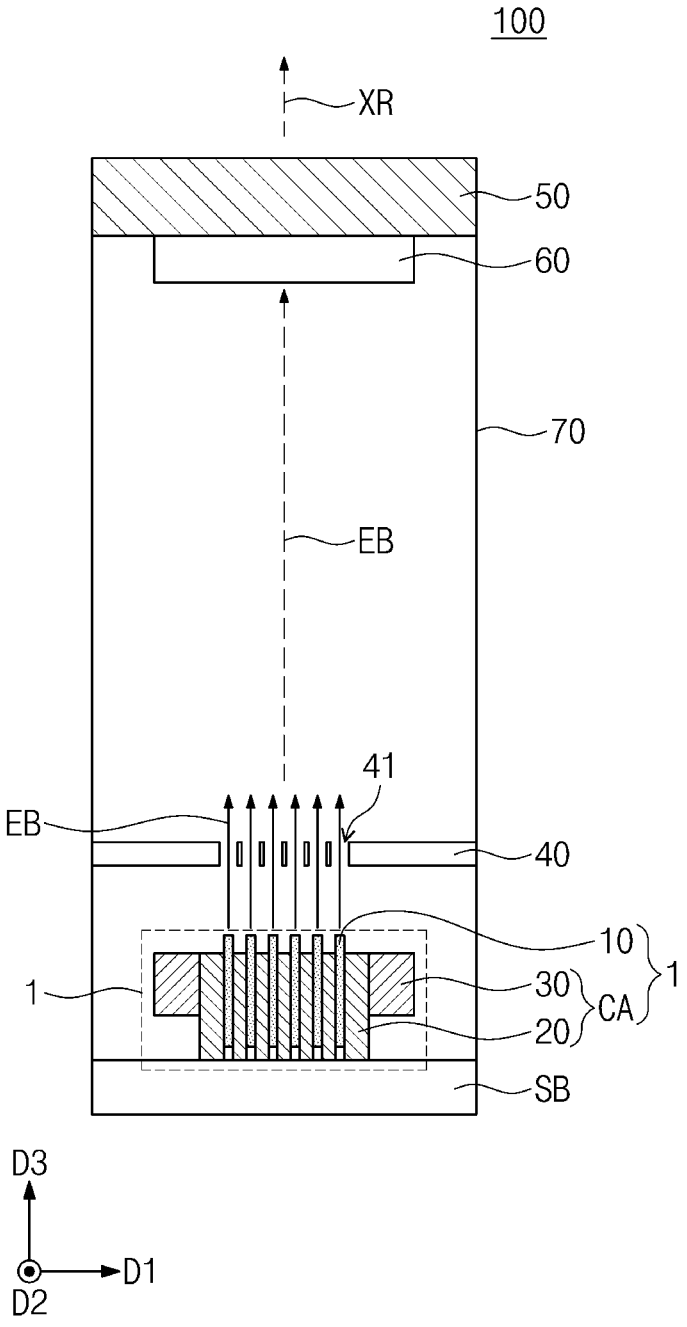
FIG. 5 is a cross-sectional view for explaining an X-ray tube according to the embodiments of the inventive concept.

FIG. 5 is a cross-sectional view for explaining an X-ray tube 100 including the electron emission structure 1 and the transmissive anode according to the embodiments of the inventive concept.

The X-ray tube 100 according to the embodiments of the inventive concept may include the electron emission structure 1, a support substrate SB, a gate electrode 40, an anode electrode 50, a target 60, and a housing 70. Each of the electron emission structures 1 corresponds to a cross-section taken along line I-I' of FIG. 1. The electron emission structure 1 may be disposed on the support substrate SB. The support substrate SB may include a conductive material or an insulating material. When the support substrate SB includes a conductive material, an external power (not shown) may be electrically connected to the support substrate SB and apply a voltage to the cathode electrode CA. When the support substrate SB includes an insulating material, the external power (not shown) may directly apply a voltage to the cathode electrode CA.

The cathode electrode CA and the anode electrode 50 may be spaced apart from each other in the third direction D3. The cathode electrode CA, the anode electrode 50, and the gate electrode 40 may be electrically connected to the external power (not shown). For example, the cathode electrode CA may be applied with a positive voltage or a negative voltage or may be grounded. A voltage having a potential relatively higher than that of the cathode electrode CA may be applied to the anode electrode 50 and the gate electrode 40.

Each of the anode electrode 50 and the gate electrode 40 may include a conductive material, e.g., copper (Cu), aluminium (Al), and molybdenum (Mo). The anode electrode 50 may be a fixed-type anode electrode 50 or a rotation-type anode electrode 50 rotating in one direction. The gate electrode 40 may be disposed between the electron emission structure 1 and the anode electrode 50. The gate electrode 40 may be disposed closer to the electron emission structure 1 than the anode electrode 50. Although each of the anode electrode 50 and the gate electrode 40 may have a circular plate shape in an embodiment, the embodiment of the inventive concept is not limited thereto. The gate electrode 40 may include a plurality of gate holes 41 passing therethrough. According to an embodiment, the X-ray tube 100 may further include a focusing electrode (not shown) disposed between the gate electrode 40 and the anode electrode 50.

The electron emission yarn 10 may emit an electron and/or an electron beam by an electric field provided by a voltage applied to the cathode electrode CA, and the gate electrode 40. An electron beam EB emitted from the electron emission yarns 10 and passed through the gate holes 41 may be accelerated and travel toward the anode electrode 50 by the voltage applied to the cathode electrode CA, gate electrode 40, and the anode electrode 50.

The electron and/or the electron beam emitted from the electron emission yarn 10 may be generated and accelerated in a vacuum state. In order to make the vacuum state, the X-ray tube 100 may be manufactured to have a completely sealed state. Alternatively, the inside of the X-ray tube 100 may have the vacuum state through a vacuum pump (not shown) connected to the outside.

The X-ray tube essentially maintains an inner vacuum environment for generating and accelerating the electron beam. According to the typical method, since an additional adhesive is used in a process of fixing the electron emission yarn 10 to the cathode electrode, the X-ray tube is relatively weak to maintain the inner vacuum environment. In case of the embodiment of the inventive concept, the electron emission yarn 10 may be mechanically fixed by the first conductive panel 20 and the second conductive panel 30 instead of using an additional adhesive material. As the additional adhesive material is not used, the vacuum environment may be maintained well relatively resulting in preventing the degradation of the electron emission yarn 10 and improved stability of the x-ray tube.

The housing 70 may include an insulation member. The housing 70 may include a material that is rigid even in a vacuum state. For example, the housing 70 may include glass or inorganic compound-based ceramics such as an aluminum oxide and an aluminum nitride.

The target 60 may be disposed on a bottom surface of the anode electrode 50. The target 60 may be a material emitting an X-ray XR when colliding with the electron beam. The target 60 may include one of molybdenum (Mo), tantalum (Ta), tungsten (W), copper (Cu), and gold (Au). The X-ray XR may be transmitted through the anode electrode 50 in the case of a transmissive anode type or reflected from the target surface and transmitted through the housing material in the case of a reflective anode type.

Figure 6:
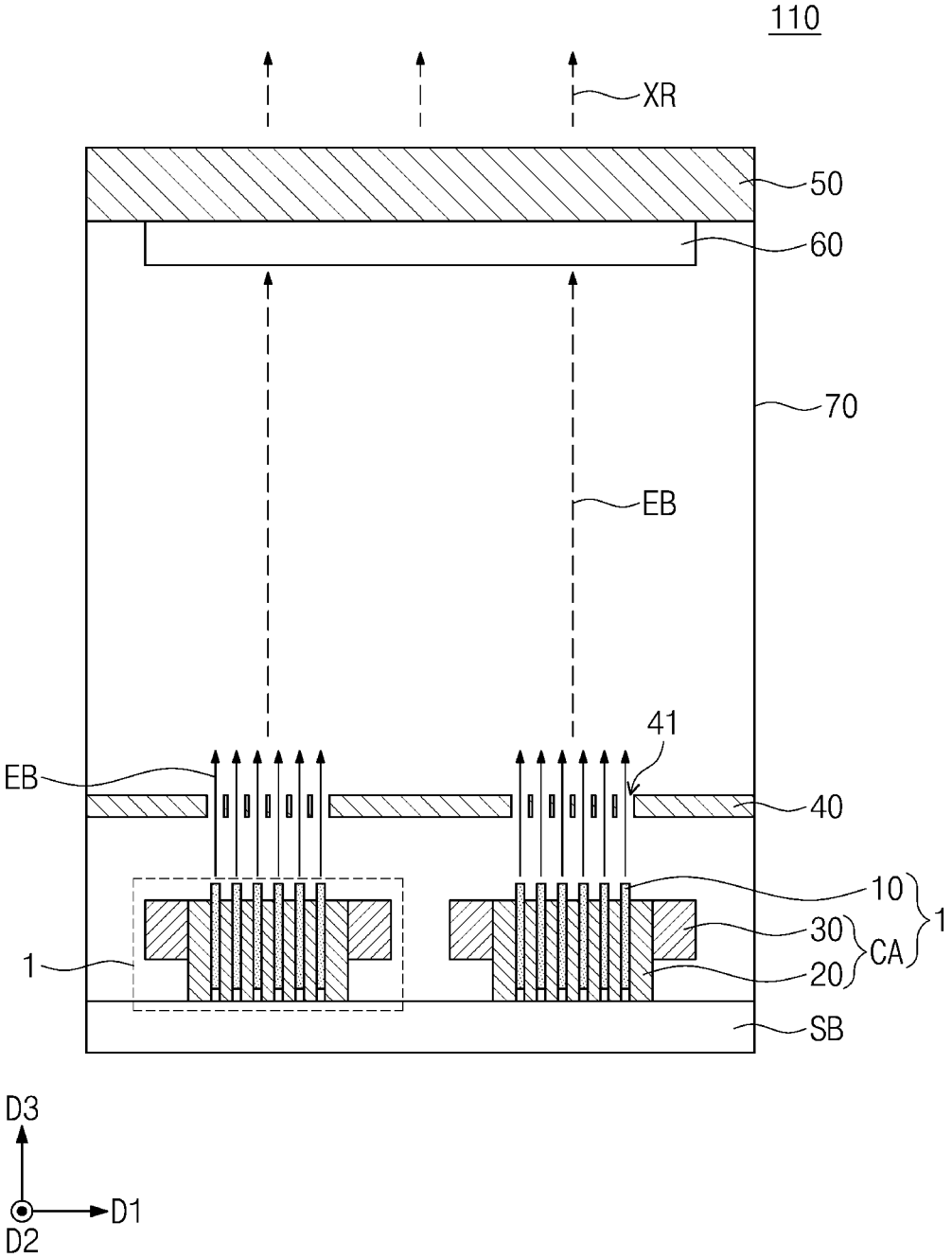
FIG. 6 is a cross-sectional view for explaining an X-ray tube according to the embodiments of the inventive concept.

FIG. 6 is a cross-sectional view for explaining an X-ray tube 110 including an electron emission structure 1 according to an embodiment of the inventive concept. Hereinafter, features overlapped with those described in FIG. 5 will be omitted.

Referring to FIG. 6, the electron emission structures 1 may be arranged in the first direction D1 and the second direction D2. The number and arrangement of the electron emission structures 1 may be freely adjusted. For example, the electron emission structures 1 may be regularly arranged in the first direction D1 and the second direction D2.

Figure 7:
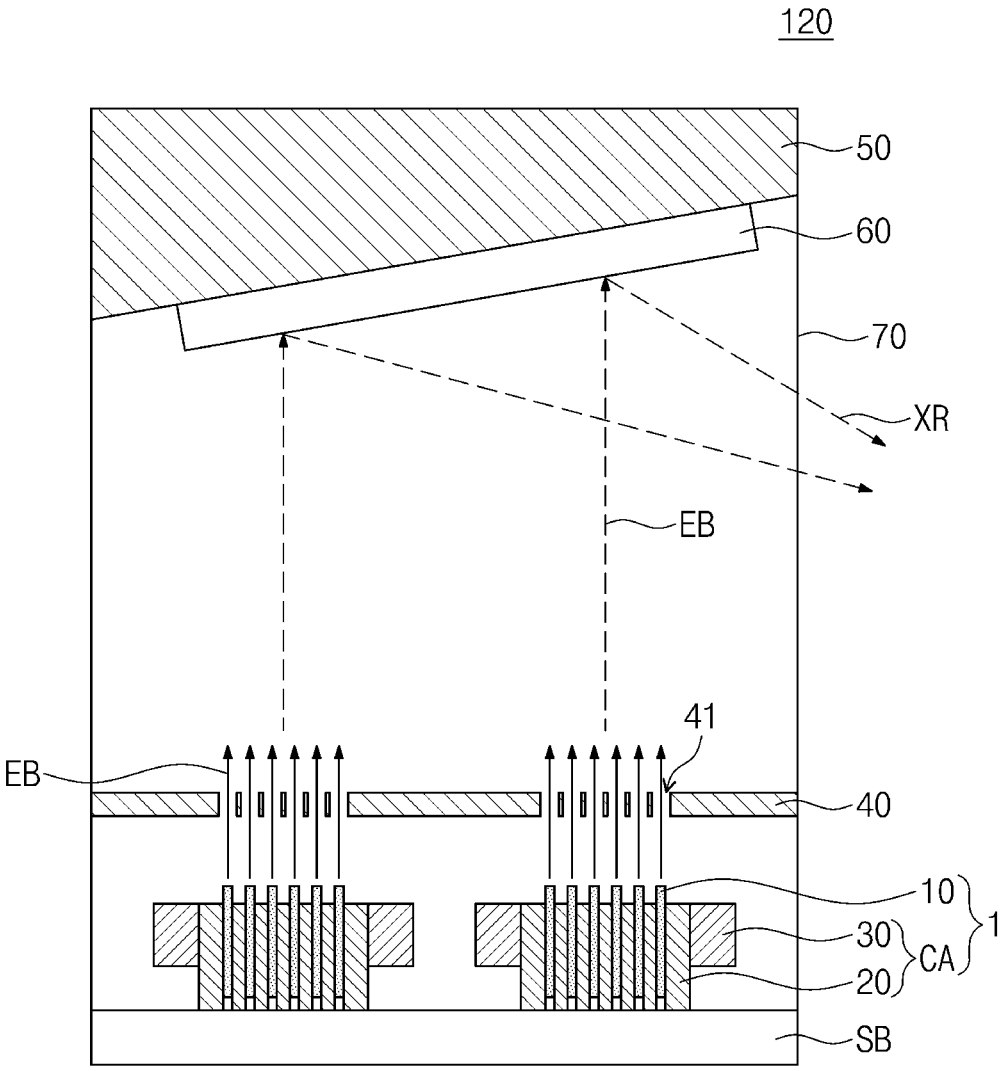
FIG. 7 is a cross-sectional view for explaining an X-ray tube according to the embodiments of the inventive concept.

FIG. 7 is a cross-sectional view for explaining an X-ray tube 120 including an electron emission structure 1 and reflective anode according to an embodiment of the inventive concept. Hereinafter, features overlapped with those described in FIG. 5 will be omitted.

Referring to FIG. 7, the X-ray tube 120 may include an anode electrode 50 having an inclined bottom surface. An X-ray XR may travel and pass through the housing material by being reflected from the target 60 surface by the inclined anode electrode 50.

Second Embodiment

Figure 8:
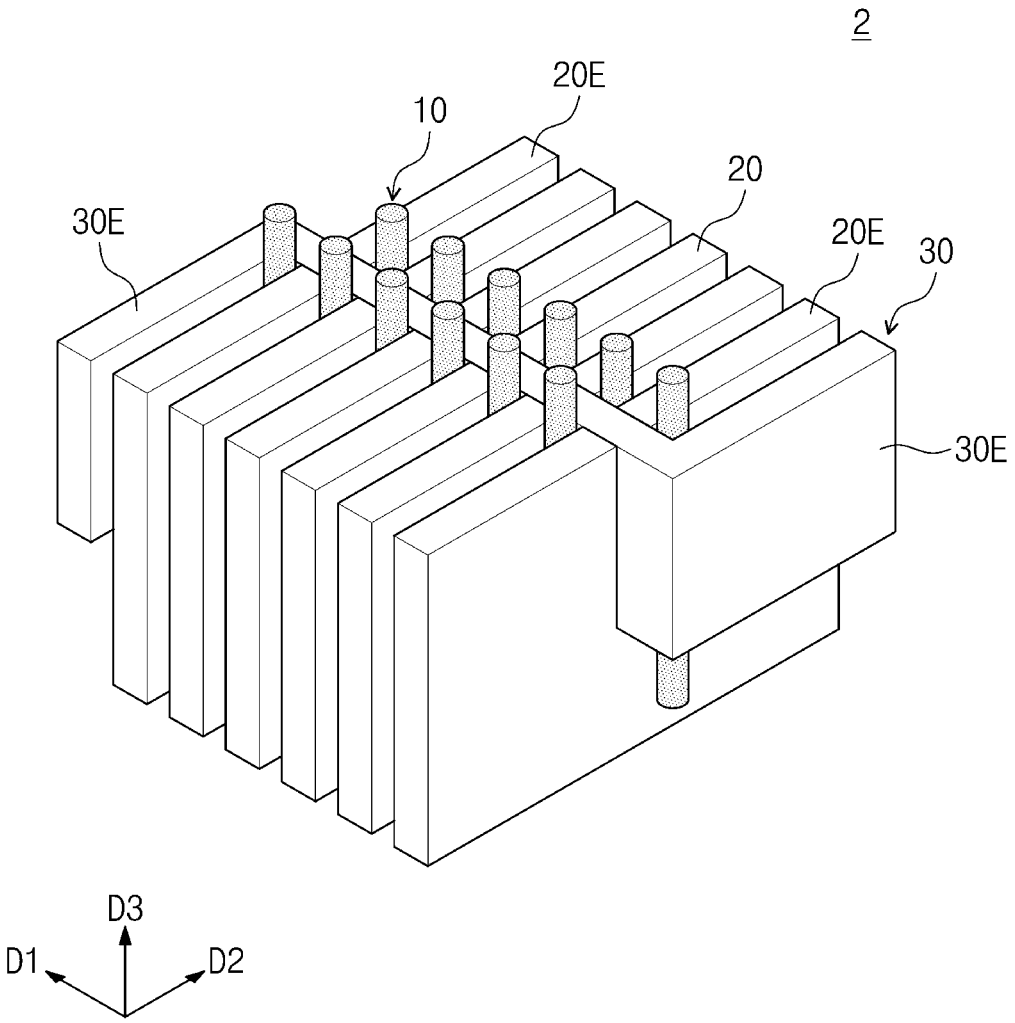
FIG. 8 is a perspective view for explaining an electron emission structure according to an embodiment of the inventive concept.
Figure 9:
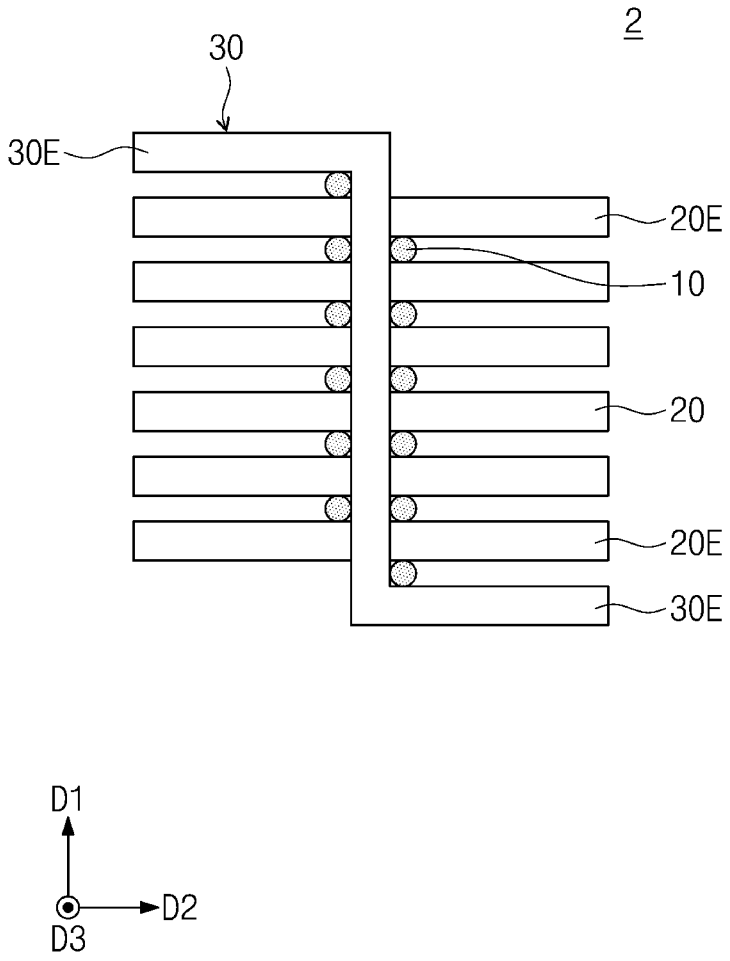
FIG. 9 is a plan view for explaining the electron emission structure according to an embodiment of the inventive concept.

FIG. 8 is a perspective view for explaining an electron emission structure according to an embodiment of the inventive concept. FIG. 9 is a plan view of FIG. 8.

Referring to FIGS. 8 and 9, each of both edges 30E of a second conductive panel 30 may be bent into an "L"-shape. Each of the both edges 30E of the second conductive panel 30 may extend in the second direction D2. Each of the both edges 30E of the second conductive panel 30 may be spaced apart from outermost first conductive panels 20E of first conductive panels 20 in the first direction D1.

A portion of electron emission yarns 10 may be disposed between the outermost first conductive panels 20E and each of the both edges 30E of the second conductive panel 30.

An electron emission structure 2 according to an embodiment of the inventive concept may be manufactured as same as or similar to the process described in FIG. 4. The electron emission yarns 1 may be fixed such that the electron emission yarns 10 are disposed between the second conductive panel 30 and the outermost first conductive panels 20E, and then the both edges 30E of the second conductive panel 30 are bent by applying a physical force.

Third Embodiment

Figure 10:
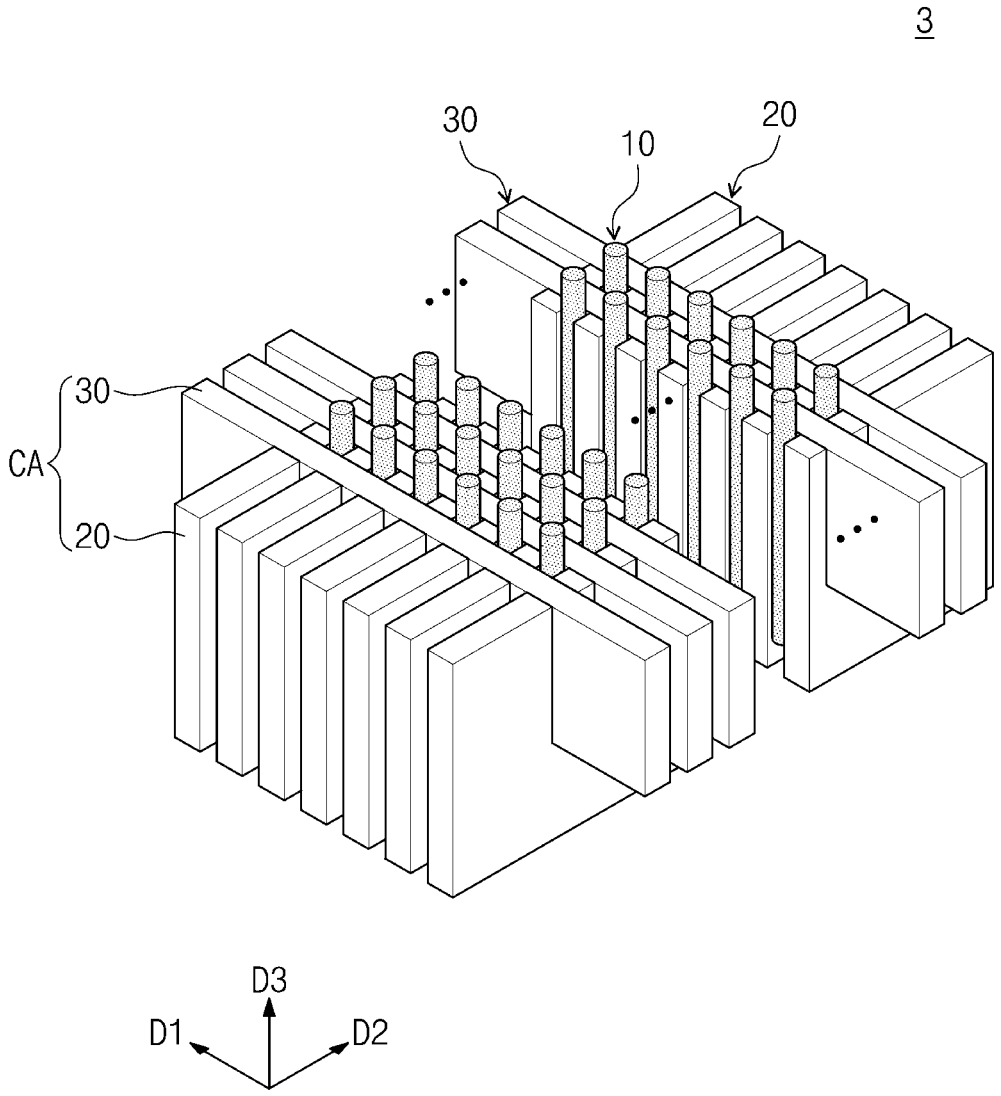
FIG. 10 is a perspective view for explaining an electron emission structure according to an embodiment of the inventive concept.
Figure 11:
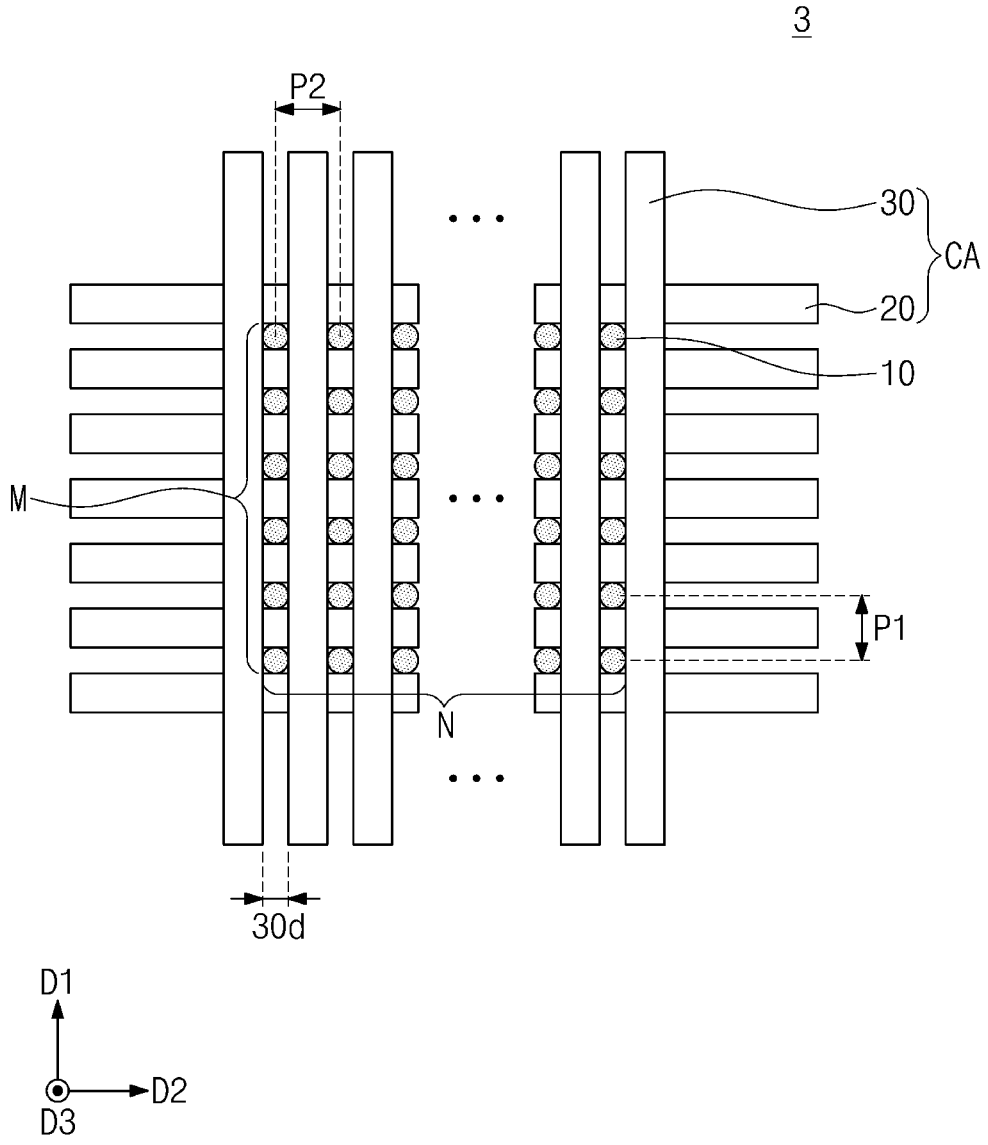
FIG. 11 is a plan view for explaining the electron emission structure according to an embodiment of the inventive concept.
Figure 12:
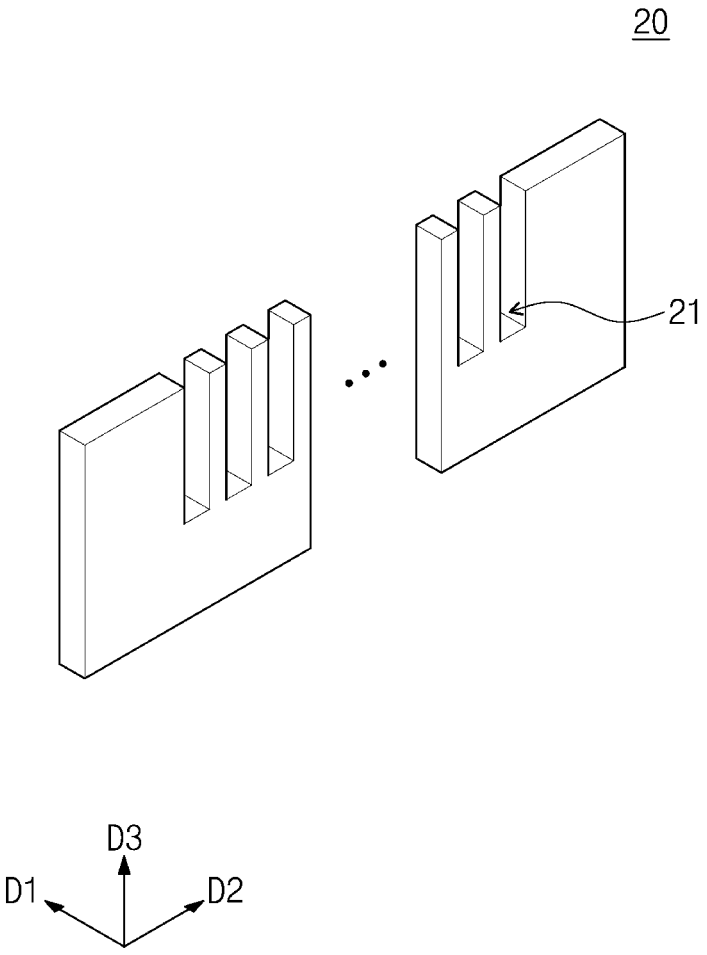
FIG. 12 is a perspective view for explaining a component of the electron emission structure according to an embodiment of the inventive concept.

FIG. 10 is a perspective view for explaining components of an electron emission structure 3 according to an embodiment of the inventive concept. FIG. 11 is a plan view illustrating the electron emission structure 3 of FIG. 10. FIG. 12 is a perspective view illustrating a first conductive panel 20 of the electron emission structure 3 of FIG. 10.

Referring to FIGS. 10 and 11, a plurality of second conductive panels 30 may be provided. The first conductive panels 20 and the second conductive panels 30 may provide a grid. That is, a cathode electrode CA may have a grid shape. Each of electron emission yarns 10 may be disposed at a corner of the grids.

Referring to FIG. 12, each of the first conductive panels 20 may include a plurality of grooves 21 at an upper portion thereof. The first conductive panels 20 may each extend in the second direction D2, and the grooves 21 may be arranged with a predetermined gap in the second direction D2.

Referring to FIGS. 10 and 11 again, each of the second conductive panels 30 may be inserted to each of the grooves 21 of the first conductive panels 20. The second conductive panels 30 may be spaced apart from each other in the second direction D2. The electron emission yarns 10 may be disposed between the second conductive panels 30. A spaced distance 30*d* between one pair of adjacent second conductive panels 30 of the second conductive panels 30 may be substantially the same as a diameter D of each of the electron emission yarns 10.

Each of the electron emission yarns 10 may be surrounded by one pair of adjacent first conductive panels 20 and one pair of adjacent second conductive panels 30. The one pair of adjacent first conductive panels 20 and the one pair of adjacent second conductive panels 30 may fix the electron emission yarns 10. The electron emission yarns 10 may contact the first conductive panels 20 and the second conductive panels 30.

As illustrated in FIG. 11, the electron emission yarns 10 may have an M×N array shape in the first direction D1 and the second direction D2. A second length L1 of the first conductive panel 20 may be greater than multiplication of a first pitch P1 and M. A third length L2 of the second conductive panel 30 may be greater than multiplication of a second pitch P2 and N.

Figure 13:
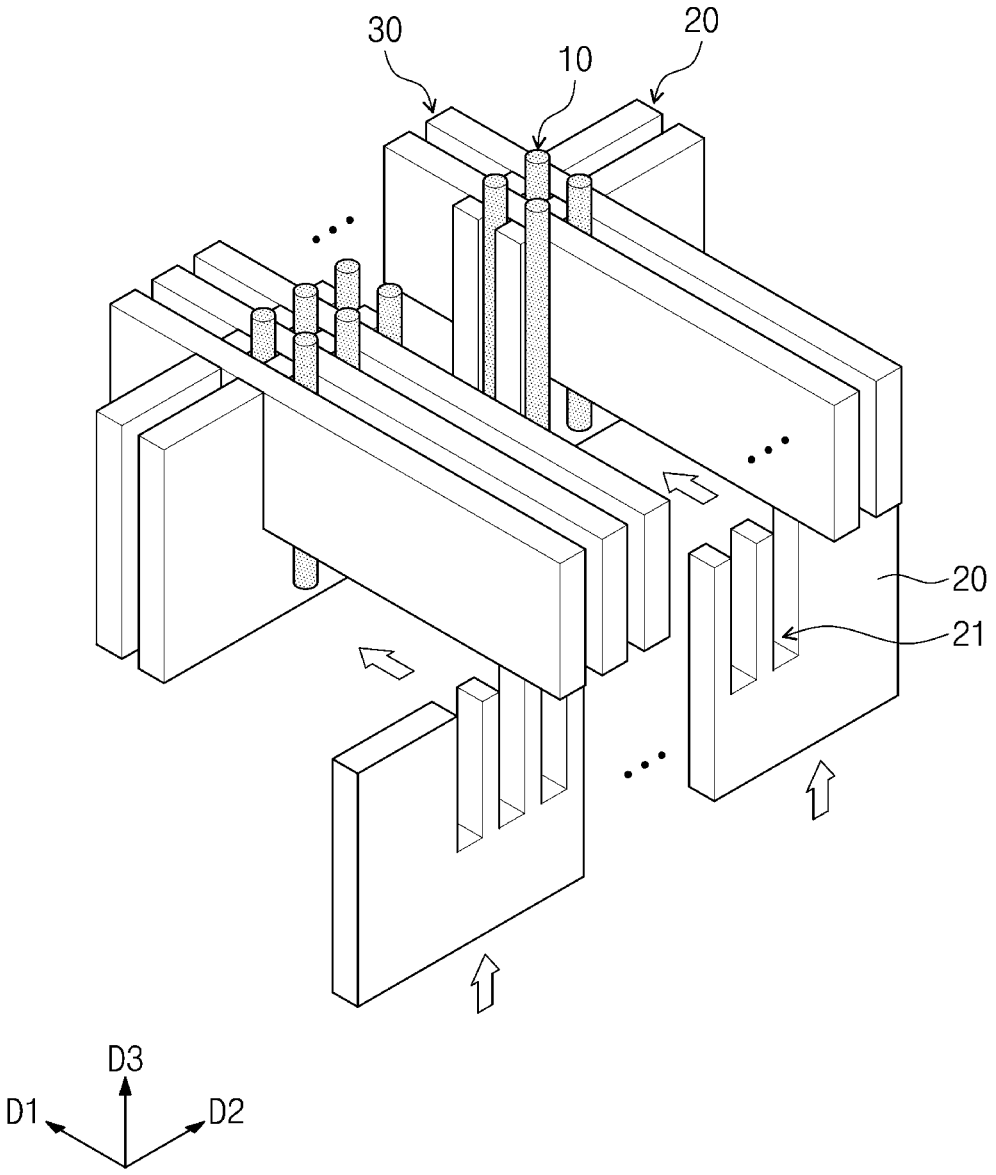
FIG. 13 is a perspective view for explaining a process of manufacturing an electron emission structure according to an embodiment of the inventive concept.

FIG. 13 is a perspective view for explaining a process of manufacturing the electron emission structure 3 of FIG. 10. Referring to FIG. 13, the second conductive panels 30 may be inserted to the grooves 21 of one first conductive panel 20. Thereafter, the electron emission yarns 10 may be inserted to corners of the grids provided by the first conductive panel 20 and the second conductive panels 30, i.e., empty spaces between the grids. One electron emission yarn 10 may be fixed by one conductive panel 20 and one second conductive panel 30 adjacent thereto. Thereafter, the second conductive panel 30 may be inserted to a plurality of grooves 21 of another first conductive panel 20. The electron emission yarn 10 may be fixed by one pair of adjacent first conductive panels 20 and one pair of adjacent second conductive panels 30.

The cathode electrode may have the grid shape, and each of the electron emission yarns may closely contact the corner of the grid shape. As the electron emission yarns each having the high aspect ratio are mechanically fixed by the cathode electrode in the longitudinal direction thereof instead of using chemical additives such as an adhesive, the stability of the electron emission structure and the X-ray tube including the same may have improved vacuum maintenance. Also, as the electron emission yarns are regularly arranged by the cathode electrode, the reliability of the electron emission structure and the X-ray tube including the same may be improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Thus, the above-disclosed embodiments are to be considered illustrative and not restrictive.

What is claimed is:

1. An electron emission structure comprising:

a cathode electrode; and electron emission yarns, each having a yarn shape and disposed in the cathode electrode, wherein the cathode electrode comprises:

a plurality of first conductive panels spaced apart from each other in a first direction; and at least one second conductive panel that crosses the first conductive panels in the first direction, wherein each of the first conductive panels comprises at least one groove at an upper portion thereof, the second conductive panel is inserted into the groove of each of the first conductive panels, each of the electron emission yarns is disposed between the first conductive panels, each of the electron emission yarns contacts the second conductive panel, and each of the electron emission yarns is mechanically fixed by the second conductive panel and one pair of adjacent first conductive panels of the first conductive panels.

2. The electron emission structure of claim 1, wherein each of the electron emission yarns contacts one pair of adjacent first conductive panels of the first conductive panels.

3. The electron emission structure of claim 1, wherein the electron emission yarns are spaced apart from each other in a second direction that crosses the first direction with the second conductive panel therebetween.

4. The electron emission structure of claim 3, wherein each of the first conductive panels and the second conductive panel has a plate shape, each of the first conductive panels has a first thickness in the first direction, each of the first conductive panels extends in the second direction, the second conductive panel has a second thickness in the second direction, and the second conductive panel extends in the first direction.

5. The electron emission structure of claim 4, wherein the electron emission yarns are arranged in the first direction and the second direction, a first pitch between one pair of electron emission yarns, which are adjacent to each other in the first direction, is a sum of the first thickness and a diameter of each of the electron emission yarns, and a second pitch between one pair of electron emission yarns, which are adjacent to each other in the second direction, is a sum of the second thickness and the diameter of each of the electron emission yarns.

6. The electron emission structure of claim 4, wherein each of both edges of the second conductive panel is bent into a "L"-shape, and each of the both edges of the second conductive panel extends in the second direction.

7. The electron emission structure of claim 6, wherein each of the both edges of the second conductive panel is spaced apart from outermost conductive panels of the first conductive panels in the first direction, and a portion of the electron emission yarns is disposed between each of the both edges of the second conductive panel and the outermost conductive panels of the first conductive panels.

8. The electron emission structure of claim 1, wherein each of the first conductive panels comprises a plurality of grooves at an upper portion thereof, the at least one second conductive panel is provided in plurality, each of the second conductive panels is inserted into each of the grooves, the second conductive panels are spaced apart from each other in a second direction that crosses the first direction, and each of the electron emission yarns is disposed between the second conductive panels.

9. The electron emission structure of claim 8, wherein a spaced distance between one pair of adjacent first conductive panels of the first conductive panels is equal to a diameter of each of the electron emission yarns.

10. The electron emission structure of claim 8, wherein a spaced distance between one pair of adjacent second conductive panels of the second conductive panels is equal to a diameter of each of the electron emission yarns.

11. The electron emission structure of claim 1, wherein an upper portion of each of the electron emission yarns vertically protrudes further than each of a top surface of each of the first conductive panels and a top surface of the second conductive panel.

12. The electron emission structure of claim 1, wherein one of the first conductive panels and the second conductive panel at least is connected to a power supply, and the first conductive panels and the second conductive panel contact each other.

13. An X-ray tube comprising:

an electron emission structure;

an anode electrode spaced vertically from the electron emission structure; and a gate electrode disposed between the anode electrode and the electron emission structure, wherein the electron emission structure comprises:

a cathode electrode having a grid shape; and electron emission yarns, each having a yarn shape and disposed at a corner of the grid shape, wherein the cathode electrode comprises:

a plurality of first conductive panels spaced apart from each other in a first direction; and at least one second conductive panel that crosses the first conductive panels in the first direction, wherein each of the first conductive panels comprises at least one groove at an upper portion thereof, the second conductive panel is inserted into the groove, and one pair of adjacent first conductive panels of the first conductive panels and a portion of the second conductive panel between the one pair of first conductive panels provide the corner of the grid shape.

14. The X-ray tube of claim 13, wherein each of the electron emission yarns contacts the one pair of first conductive panels and the second conductive panel.

15. The X-ray tube of claim 13, wherein each of the electron emission yarns has a height greater than that of the second conductive panel and equal to or less than that of each of the first conductive panels.

16. The X-ray tube of claim 13, wherein each of the electron emission yarns is fixed by the first conductive panels and the second conductive panel.

17. The X-ray tube of claim 13, wherein the groove has a width in a second direction that crosses the first direction, the second conductive panel has a thickness in the second direction, and the thickness of the second conductive panel is equal to the width of the groove.

18. The X-ray tube of claim 13, wherein the groove has a depth in a vertical direction, the second conductive panel has a height in the vertical direction, and the height of the second conductive panel is equal to the depth of the groove.

* * * * *